US009791145B2

(12) United States Patent
Selfridge, Jr. et al.

(10) Patent No.: US 9,791,145 B2
(45) Date of Patent: Oct. 17, 2017

(54) METHOD AND APPARATUS FOR MANIPULATING EQUIPMENT INSIDE A STEAM GENERATOR

(71) Applicant: Westinghouse Electric Company LLC, Cranberry Township, PA (US)

(72) Inventors: David W. Selfridge, Jr., Greensburg, PA (US); Martin Le Goff, Irwin, PA (US)

(73) Assignee: Westinghouse Electric Company LLC, Cranberry Township, PA (US)

( * ) Notice: Subject to any disclaimer, the term of this patent is extended or adjusted under 35 U.S.C. 154(b) by 470 days.

(21) Appl. No.: 14/338,368

(22) Filed: Jul. 23, 2014

(65) Prior Publication Data

US 2014/0360443 A1 Dec. 11, 2014

Related U.S. Application Data

(63) Continuation-in-part of application No. 13/802,960, filed on Mar. 14, 2013, now abandoned.

(51) Int. Cl.

| | |
|---|---|
| ***F22B 37/48*** | (2006.01) |
| ***F22B 37/54*** | (2006.01) |
| ***F28G 13/00*** | (2006.01) |
| ***F28G 1/00*** | (2006.01) |
| ***F28G 15/08*** | (2006.01) |
| ***F22B 1/02*** | (2006.01) |

(Continued)

(52) U.S. Cl.

CPC ..... *F22B 37/483* (2013.01); *F22B 1/025* (2013.01); *F22B 37/003* (2013.01); *F22B 37/54* (2013.01); *F28G 1/00* (2013.01); *F28G 13/00* (2013.01); *F28G 15/08* (2013.01); *F28D 7/06* (2013.01)

(58) Field of Classification Search

CPC ..... F22B 37/483; F22B 37/54; F28G 15/04; F28G 1/16

See application file for complete search history.

(56) References Cited

U.S. PATENT DOCUMENTS

| | | |
|---|---|---|
| 4,079,701 A | 3/1978 | Hickman et al. |
| 4,273,076 A | 6/1981 | Lahoda et al. |

(Continued)

OTHER PUBLICATIONS

International Search Report and Written Opinion of the International Searching Authority for PCT/US2014/051463 dated Mar. 31, 2015 (Forms PCT/ISA/220, PCT/ISA/210, PCT/ISA/237).

*Primary Examiner* — Alissa Tompkins
*Assistant Examiner* — Nathaniel Herzfeld
(74) *Attorney, Agent, or Firm* — Eckert Seamans Cherin & Mellott, LLC; Daniel C. Abeles

(57) ABSTRACT

A method and apparatus for manipulating a tool within the secondary side of a steam generator having a tube sheet with a tube bundle having a plurality of heat exchange tubes extending from the tube sheet in rows with an annulus extending around the heat exchange tubes on a periphery of the tube bundle, between the tubes and a wrapper which surrounds the tube bundle. A robot is introduced into the annulus and extends a probe with a tool across selected lanes between the rows of tubes. A method and apparatus is also disclosed for cleaning sludge from the top of a tube sheet that includes introducing a moveable suction apparatus having attached vacuum inlets into either the no tube lane or the circumferential annulus and sludge vacuuming the top of the tube sheet.

16 Claims, 9 Drawing Sheets

(51) Int. Cl.
*F22B 37/00* (2006.01)
*F28D 7/06* (2006.01)

(56) References Cited

U.S. PATENT DOCUMENTS

| | | | | |
|---|---|---|---|---|
| 4,638,667 | A * | 1/1987 | Zimmer | F22B 37/002 134/113 |
| 4,848,278 | A * | 7/1989 | Theiss | F22B 37/483 122/383 |
| 5,019,329 | A * | 5/1991 | Franklin | F28G 7/00 122/382 |
| 5,036,871 | A | 8/1991 | Ruggieri et al. | |
| 5,286,154 | A * | 2/1994 | Jens | B25J 18/06 294/100 |
| 5,611,391 | A * | 3/1997 | Hyp | F22B 37/002 165/11.1 |
| 7,162,981 | B2 | 1/2007 | Hernandez | |
| 8,238,510 | B2 | 8/2012 | Haberman | |
| 8,605,145 | B2 | 12/2013 | Webster et al. | |
| 2006/0207525 | A1* | 9/2006 | Hernandez | F22B 37/486 122/396 |
| 2010/0011522 | A1* | 1/2010 | Kim | F22B 37/003 15/3 |
| 2010/0071734 | A1 | 3/2010 | Kim et al. | |
| 2010/0275691 | A1* | 11/2010 | Roberts | G01N 27/90 73/622 |
| 2011/0000643 | A1* | 1/2011 | Kim | F22B 37/002 165/95 |
| 2012/0330407 | A1* | 12/2012 | Dale | A61B 17/122 623/2.11 |

* cited by examiner

METHOD AND APPARATUS FOR MANIPULATING EQUIPMENT INSIDE A STEAM GENERATOR

CROSS REFERENCE TO RELATED APPLICATION

This application is a continuation-in-part patent application of U.S. Ser. No. 13/802,960, filed Mar. 14, 2013, entitled LOCALIZED VACUUM REMOVAL OF STEAM GENERATOR DEPOSITS.

BACKGROUND

1. Field

This invention relates to steam generators and more particularly to methods and apparatus for manipulating equipment around the secondary side of a tube sheet of steam generators.

2. Description of Related Art

A nuclear steam generator is a pressurized vessel divided into a primary and a secondary side. The primary and the secondary sides are separated by the "tube sheet". As in any heat exchanger, both primary and secondary sides have an inlet and an outlet. In order to increase the heat exchange surface, the tube sheet is drilled with a plurality of holes organized in two groups. The primary side is divided in two sections by a "divider plate" in a way that one group of holes communicates with the primary side inlet (to form the "hot leg") and the second group of holes communicates with the primary side outlet (to form the "cold leg"). U-shaped tubes attached to the tube sheet extend in the secondary side and connect the holes from the hot leg to the holes from the cold leg. These U-shaped tubes form the tube bundle. The primary hot water can now enter the hot leg, travel through the tubes where the heat transfer takes place and leave the steam generator through the cold leg. On the secondary side, relatively cold water ("feedwater") enters through the secondary side inlet ("feed water nozzle"), turns into steam from the heat transfer through the tubes and the steam exits through the secondary side outlet ("steam nozzle"). This configuration is described, for example, in U.S. Pat. Nos. 8,238,510; 5,036,871; 4,273,076; and 4,079,701 (Haberman; Ruggieri et al.; Lahoda et al. and Hickman et al., respectively), many of which relate to top of tube sheet sludge removal.

Since the primary fluid contains radioactive particles and is isolated from the feedwater only by the U-tubes, the U-tube walls are the boundary for isolating these radioactive particles from the secondary side. It is, therefore, important that the U-tubes be maintained defect-free so that no leaks/breaks will occur in the U-tubes.

A variety of degradation mechanisms have been experienced on the shell side of steam generators, i.e., the secondary side. These degradation mechanisms may be loosely divided into two categories; mechanical degradation, such as wear or denting and chemical induced degradation such as stress corrosion cracking (SCC) or Inter/transgranular attack. High caustic levels found in the vicinity of the cracks in tube specimens taken from operating steam generators and the similarity of these cracks to failures produced by caustic environments under controlled laboratory conditions, have identified high caustic levels as the possible cause of the intergranular corrosion, and thus the possible cause of the tube cracking. Acidic conditions have also empirically demonstrated the ability to cause tubing degradation. Elevated concentrations of deleterious species such as lead or copper and conditions with an elevated electrochemical potential are also catalysts for tubing accelerated degradation as a result of localized mechanical stresses from deformation of tubing via in situ formation of magnetite, known as denting. These degradation mechanisms typically occur in the vicinity of a sludge pile present on the top of tube sheet on the shell side of the steam generator. The sludge is mainly iron oxide particulates and copper compounds along with traces of other minerals that have settled out of the feedwater onto the tube sheet, and into the annulus between the tube sheet and the tubes. The level of sludge accumulation may be inferred by eddy current testing with a low frequency signal that is sensitive to the magnetite in the sludge. The correlation between sludge levels and the tubing degradation location strongly suggests that the sludge deposits provide a site for concentration of impurities at the tube wall that results in the onset of tubing degradation. Loose parts within the secondary side can also result in tube wall degradation and can also settle out on top of the tube sheet.

To remove these deposits, sludge lancing and inspections are performed every one to two refueling outages. Currently, standard practice involves spraying high pressure water through the tube bundle and directing the flow to suction hoses where the loose deposits can be removed and filtered. These suction hoses may be located at a substantial distance from the completely separate high pressure lance. This prior art process typically requires large pumping and filtration systems which use several hoses to deliver the cleaning media, which can be located over 500 feet away. The high pressure water is typically delivered from the "no" (central) tube lane (lane without tubes separating the hot leg side from the cold leg side of the tube bundle under the U-bend region) of the steam generator and "pushes" the deposits into the suction hose system. The lancing process requires the tube sheet to be lanced several times to ensure satisfactory cleanliness results, which is time consuming and not cost effective.

In most nuclear steam generators in service today, there are usually 6 inch (15.2 cm.) diameter hand holes in the shell of the steam generator near and above the tube sheet that has an associated hole in the wrapper providing access to the tube sheet for removal of the sludge deposits.

In regard to the description of the related art set forth above, there is a need for a method and apparatus that can effectively clean and remotely inspect the top of the tube sheet of a steam generator with a relatively low cost and high efficiency, without requiring multiple passes to obtain a satisfactory result. Accordingly, it is a main object of this invention is to provide such a method and apparatus.

SUMMARY

The above mentioned problems are solved and object accomplished by providing a novel method of manipulating a tool, such as a video imaging device and/or sludge removal tool, within the secondary side of a steam generator having a tube sheet with a tube bundle having a plurality of heat exchange tubes extending from the tube sheet in rows with an annulus extending around the heat exchange tubes on a periphery of the tube bundle, between the tubes and a wrapper which surrounds the tube bundle. In one embodiment the method includes the step of inserting a robotic vehicle for transporting the tool, through the wrapper and into the annulus with the robotic vehicle sized to ride in the annulus. The robotic vehicle is then positioned so that the tool is aligned in a gap between two rows of the heat exchanger tubes and the tool extends a substantial distance into the lane. The tool is operated while in an extended position within the tube gap to obtain access around and between the tubes and, more preferably, as the tool is being extended. In one such embodiment the tool is suspended from a wand that has a capable bend radius and length to be contained in a reel delivery system wherein the extending step includes the step of rotating the reel to advance the tool into and through the tube lane. The method may also include the steps of withdrawing the tool from the tube gap; repositioning the robotic vehicle aligned with another tube gap; and inserting the tool through the another tube gap. In still another embodiment the robotic vehicle has a wand with a bend radius capable of traveling around an approximate ninety degree turn or bend wherein the lance is, at least in part, slidably supported in or on the robotic vehicle and extends out of the robotic vehicle a distance, substantially parallel to the tube sheet, at least as long as a distance the tool is to be inserted into the tube lane. In the foregoing embodiment one end portion of the lance extends along the annulus and is connected to a second robotic vehicle and another end portion of the lance, bent the approximate ninety degrees, carries the tool. In the latter embodiment the step of extending the tool comprises moving the second robotic toward the first robotic vehicle.

The invention also contemplates a remotely controlled robotic system for manipulating a tool over a tube sheet with a tube bundle within a secondary side of a tube and shell steam generator; the tube bundle having a plurality of heat exchange tubes extending from the tube sheet in rows with an annulus extending around the heat exchange tubes on a periphery of the tube bundle, between the tubes and a wrapper which surrounds the tube bundle. The robotic vehicle is sized to ride in and at least partially around the annulus. A wand is supported on and extendable from the robotic vehicle substantially through a lane between two rows of heat exchanger tubes and is retractable, through the robotic vehicle, out of the tube gap; the tool being supported form an end portion of the wand. A controller is provided for controlling the extension of the wand and the operation of the tool during the extension.

In another embodiment of the robotic system the robotic vehicle includes a lance with a bend radius capable of traveling around an approximate ninety degree turn or bend, wherein the lance is at least in part, slidably supported in or on the robotic vehicle and extends out of the robotic vehicle, in the annulus, a distance substantially parallel to the tube sheet, at least as long as a distance the tool is to be inserted into the tube lane. One end portion of the lance extends along the annulus and is connected to a second robotic vehicle and another end portion of the lance, bent the approximate ninety degrees, supports the tool; the second robot being sized to travel in the annulus.

The invention further contemplates a method of sludge removal from the top of tube sheet surface in a tube and shell steam generator having a plurality of entry handholes allowing access to the no tube lane and to the circumferential annulus between the wrapper and the shell, comprising the steps of: 1) opening at least one handhole allowing access to the no tube lane and/or to the circumferential annulus. 2) introducing at least one moveable sludge suction apparatus within the no tube lane and/or the circumferential annulus, said apparatus includes a suction head with at least one vacuum inlet fitting; and 3) sludge vacuuming the hot leg side and cold leg side of the tube bundle and top tube sheet surface with the moveable sludge suction apparatus, allowing continuous vacuuming of sludge in the hot and cold sides of the tube bundle; in one embodiment without the introduction of pressurized cleaning water during sludge vacuuming removal activity.

The invention also resides in use of a moveable sludge suction apparatus. The said apparatus is able to deliver a wand and a suction head assembly into the tube bundle and has an optional light and visual means. The wand connects the suction head to the suction apparatus and the optical device acts to inspect sludge removal from the top of the tube sheet.

The method proposed in this invention approaches sludge removal through a local, in-bundle suction method. This method gives the ability to clean specific areas of interest allowing for less time to be spent on areas already cleaned or more time for heavier loaded regions. The method preferably includes visual inspection capabilities to provide "live" cleanliness results, eliminating the need to perform a separate inspection that follows typical prior art sludge lancing. The inspection capabilities also provide 100% accessible in-bundle tube sheet inspections. Currently, in-bundle inspections are performed separately, following the acceptance of sludge lancing results, and on a limited scope basis.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompany drawings, wherein:

DESCRIPTION OF THE PREFERRED EMBODIMENT

Figure 1:
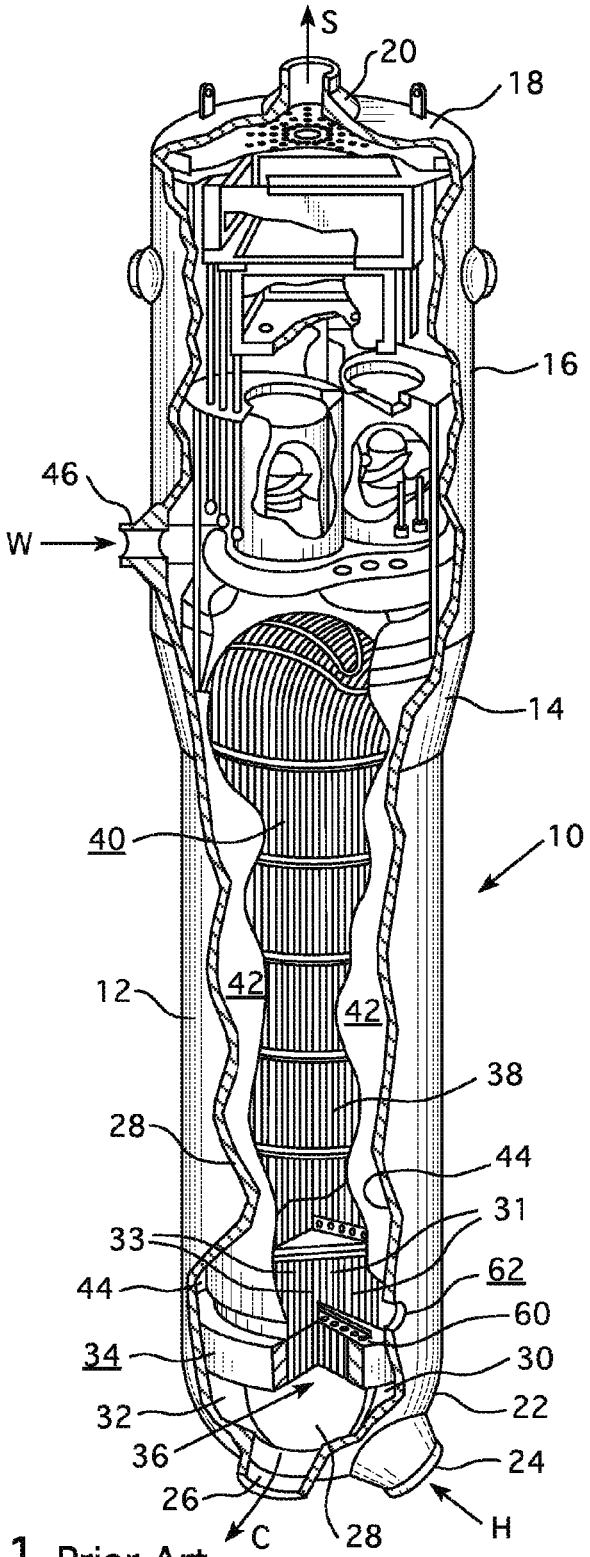
FIG. 1 Prior Art
FIG. 1 is an elevational view of one example of a typical tube and shell nuclear steam generator.

In order to better understand the invention, reference is made to FIG. 1 which shows a conventional U-tube type steam generator which has a tube sheet that supports a bundle of heat transfer U-tubes. During operation, sludge forms on the tube sheet around the U-tubes and in the annulus surrounding the tubes, causing a potential failure of the tubes. Failure of the tubes may result in a release of radioactive particles from the primary reactor coolant into the secondary side system. The invention, herein described, is a method and apparatus for manipulating a tool to more effectively and efficiently inspect the tube sheet and adjacent surfaces of the tubes and remove the sludge accumulation by a vacuum process rather than the high pressure process performed by the prior art.

Referring now to FIG. 1, the nuclear steam generator 10, comprises a lower shell 12 connected to a frustoconical transition shell 14 which connects lower shell 12 to an upper shell 16. A dished head 18 having a steam nozzle 20 disposed thereon encloses the upper shell 16 while the steam generator bowl 22 having inlet nozzle 24 and an outlet nozzle 26 disposed thereon encloses the lower shell 12. A divider plate 28 centrally disposed in the steam generator bowl 22 divides the steam generator bowl 22 into an inlet compartment 30 and an outlet compartment 32 with each compartment capped by the tube sheet 34. The inlet compartment 30 is in fluid communication with inlet nozzle 24 while outlet compartment 32 is in fluid communication with outlet nozzle 26. Tube sheet 34, having tube holes 36 therein, is attached to lower shell 12 and the steam generator bowl 22 so as to isolate the portion of steam generator 10 above tube sheet 34 from the portion below tube sheet 34 in a fluid tight manner.

Again, referring to FIG. 1, in operation, hot reactor coolant fluid H having been heated from circulation through the reactor core enters steam generator 10 through inlet nozzle 24 and flows into inlet compartment 30. From inlet compartment 30, the reactor coolant fluid flows through the tubes 38 in the tube sheet 34, up through the U-shaped curvature of tubes 38, down through tubes 38 into outlet compartment 32. From the outlet compartment 32, the now cooler (due to heat transfer) reactor coolant C is passed through outlet nozzle 26 and circulated through the remainder of the reactor coolant system. The inlet side of the tube bundle provides a tube hot leg 31 and the tube return provides a tube cold leg 33 which exits to the outlet compartment 32.

During operation, inlet feedwater W enters steam generator 10 through feedwater inlet nozzle 46, flows through a feedwater header, and out of the feedwater header through discharge ports. The greater portion of the feedwater exiting the discharge ports, flows down annular chamber 44 until the feedwater contacts tube sheet 34. Once reaching the bottom of annular chamber 44 near the tube sheet 34, the feedwater is directed inward around the tubes 38 of tube the bundle 40, which itself is enclosed a distance above the tube sheet by the wrapper 42, where the feedwater passes in a heat transfer relationship with the tubes 38. The hot reactor coolant fluid H in the tubes 38 transfers heat through tubes 38 to the feedwater thereby heating the feedwater. The heated feedwater then rises by natural circulation up through the tube bundle 40. In its travel around tube bundle 40, the feedwater continues to be heated until steam S is produced and passes through the steam nozzle 20.

Figure 2:
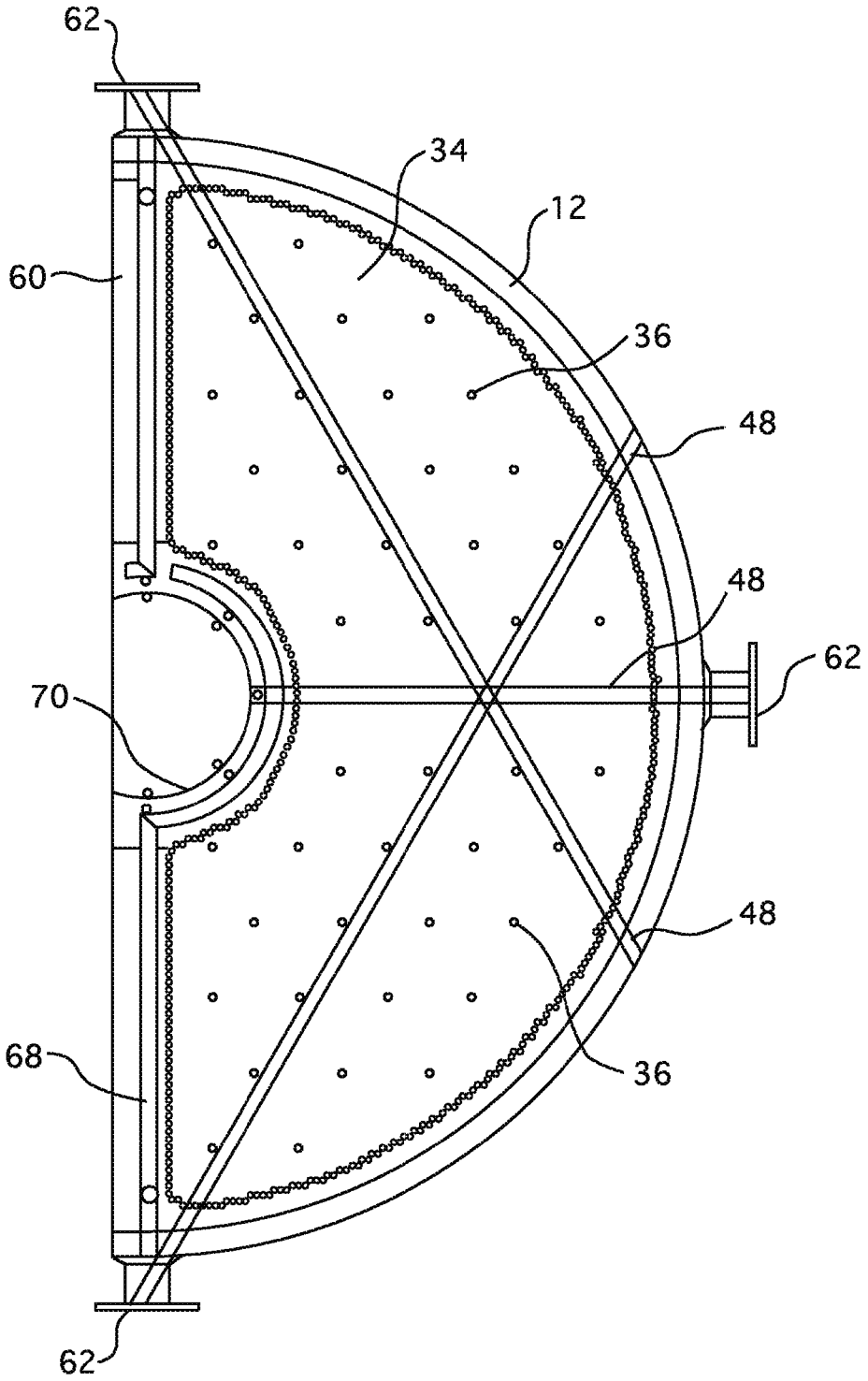
FIG. 2 Prior Art
FIG. 2 is a schematic plan view of half of a tube sheet of a tube and shell steam generator.

In its broadest sense this invention contemplates a method and apparatus for remotely manipulating a tool within the secondary side of a tube and shell steam generator to characterize and/or service a portion of the secondary side to assess and manage the integrity of the heat exchange tubes. FIG. 2 shows a schematic plan view of approximately half of a tube sheet 34. Currently, most steam generator in bundle inspections are performed by delivering tooling through the handholes 62 that utilizes the no tube lane 60 of the steam generator. The issue with this method is there are often obstructions in the region, e.g., tube lane blocks, divider plates 68, center stay Cylinders 70, etc., that can prevent the tooling from being delivered. An example of this can be seen in FIG. 2. In this example, of the two hundred two tube columns, nine, represented by the lines 48 extending from the handholes 62 along the line of sight, are able to be inspected with the current methods. In addition, this prior art delivery method only allows for the tube columns to be inspected, leaving areas behind the tubes uninspected which could cause a loose part to be missed during the inspection.

Figure 3:
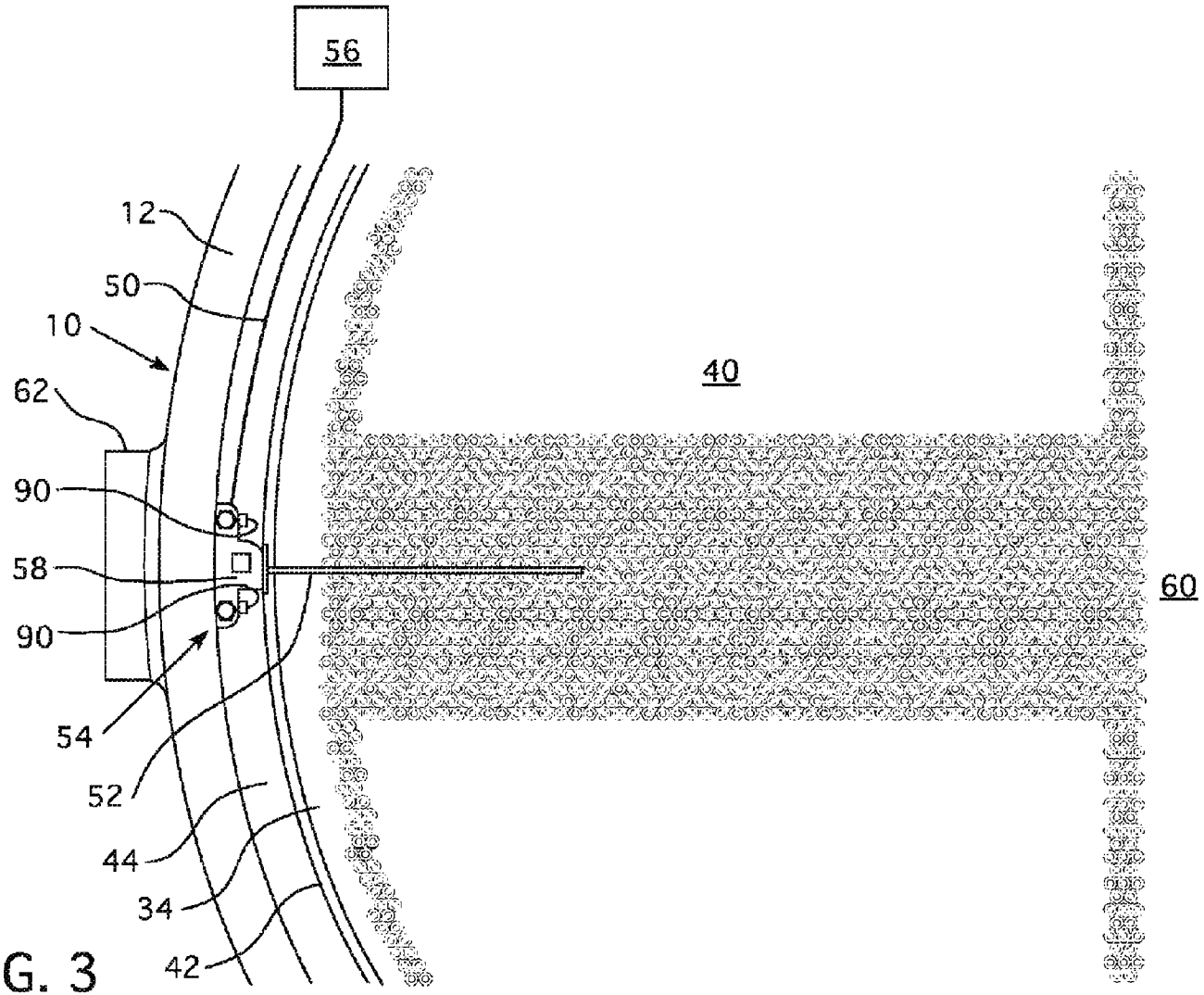
FIG. 3 is an enlarged portion of the schematic shown in FIG. 1 with a robotic vehicle of one embodiment of this invention shown in the annulus between the tube bundle and the shell.
Figure 4:
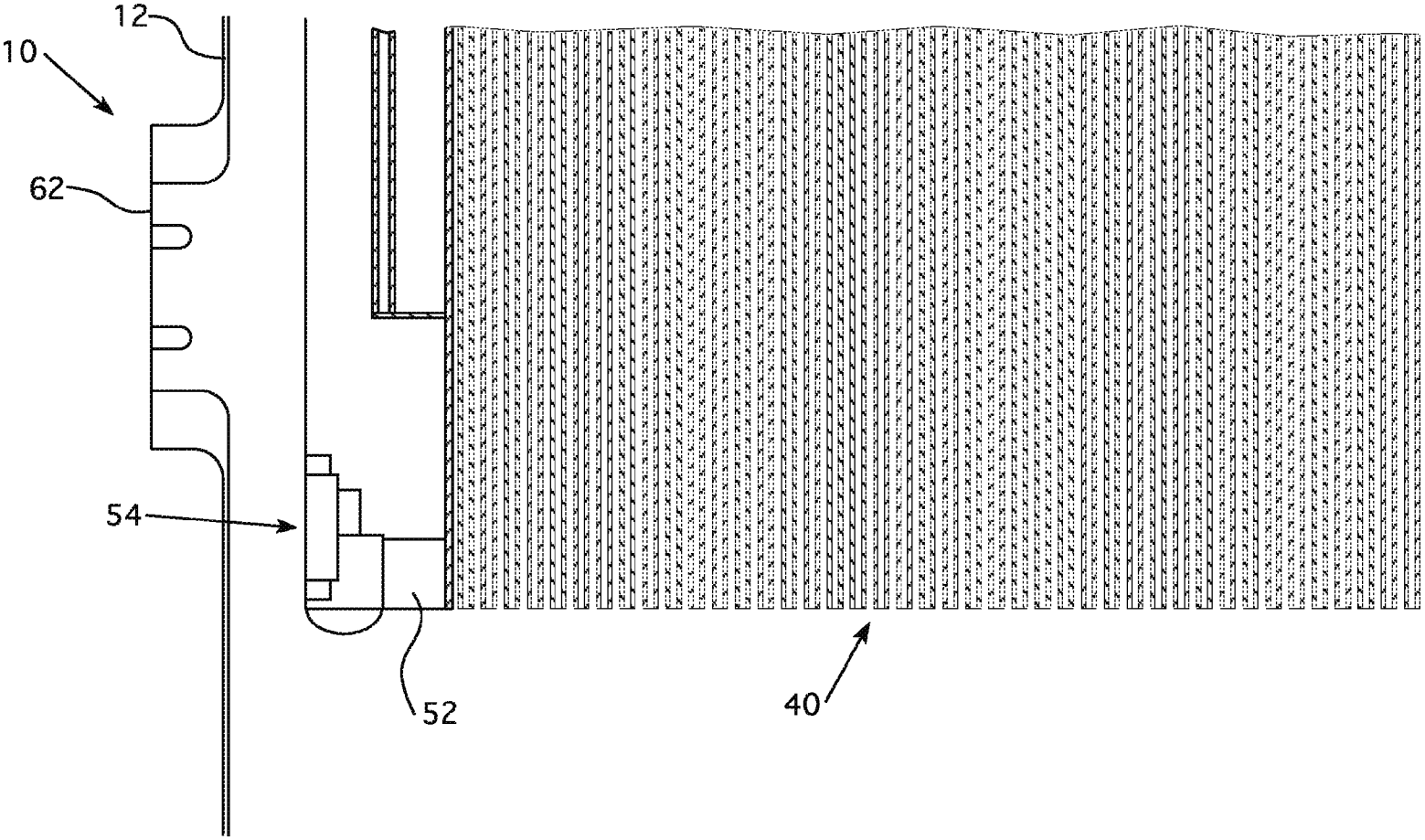
FIG. 4 is a cross-sectional side view of a portion of the schematic shown in FIG. 3.

The preferred method and apparatus for one embodiment of the delivery for the intended process, i.e., inspection, assessment, sludge removal or repair, is shown in FIGS. 3 and 4, and would include an inspection probe 52, delivery robot 54, control/signal cable 50 and control box/video processor 56. It should be appreciated that this only one of many possible embodiments of the inventions claimed hereafter. As shown, the inspection probe 52 has a capable bend radius and length to be contained in a reel delivery system 58 that is driven around the steam generator annulus 44, stopping at each tube gap of interest where the inspection probe is then delivered in bundle which traverses through the entire tube gap distance. Preferably the delivery platform, i.e., the robot 54 has forward and rear facing cameras 90 that can continuously view the inspection probe insertion point, as well as have the ability to perform foreign object search from outside the steam generator tube bundle 40. The inspection probe 52 comprises an extendable lance with a sensor on the end. The sensor may be a camera or other surveillance tool. While a reel delivery system was mentioned it should be appreciated that other mechanisms for extending the probe may be employed, such as a telescoping probe to extend the sensor through the tube lanes.

Figure 5:
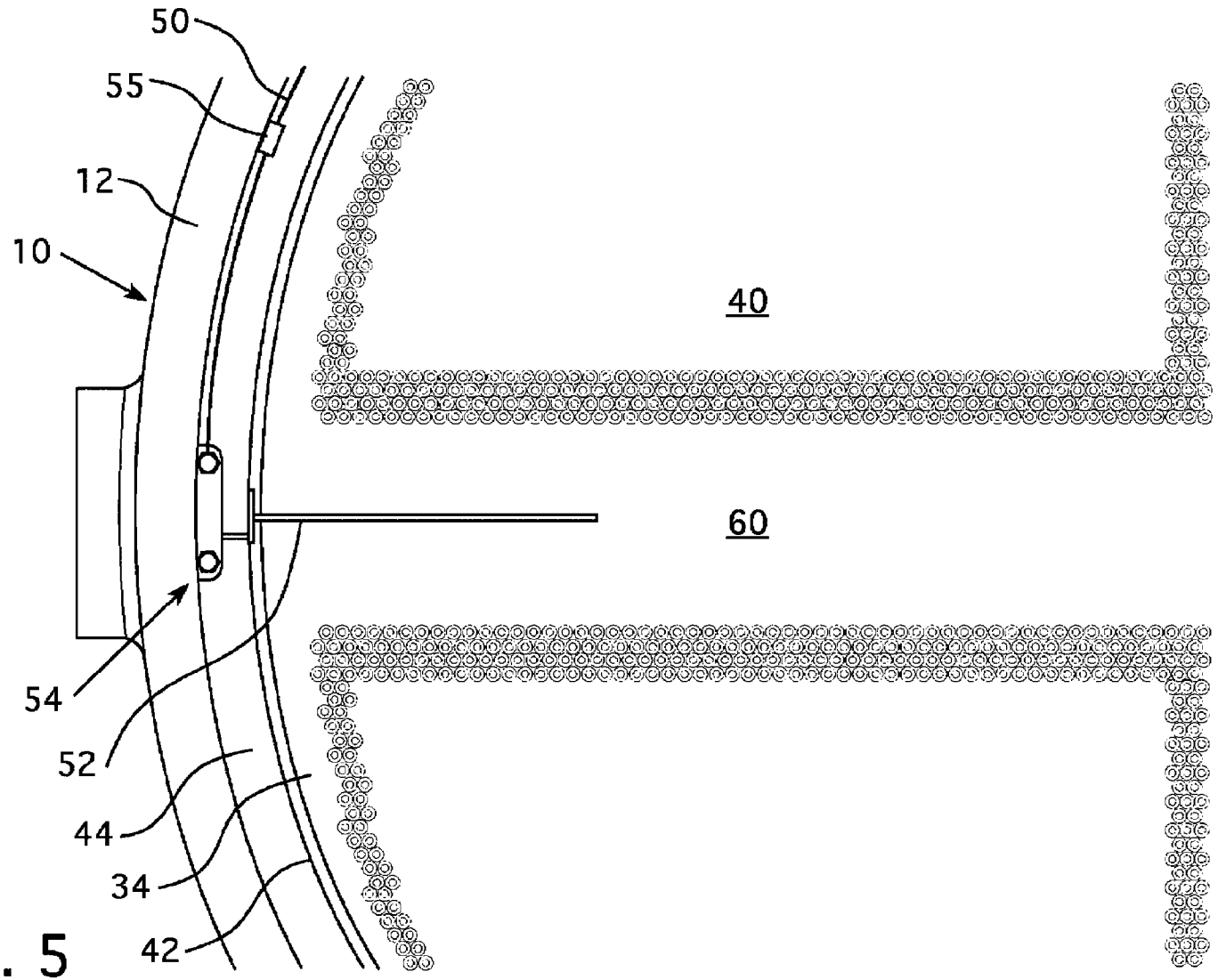
FIG. 5 is an enlarged portion of the schematic shown in FIG. 1 showing a second embodiment of this invention.

One of several alternate embodiments is shown in FIG. 5. This second embodiment incorporates a secondary robot 55, which would be used to aid in the delivery of the inspection probe 52. Rather than a reel system being used, the probe would be kept under a small amount of tension and the length would be pulled or pushed around the length of the annulus 44 depending on the length required inside of the tube bundle 40.

This invention further contemplates a method for deposit removal from the top of tube sheet of steam generators which can benefit from the delivery system identified above to reach more of the spaces between the tubes. The method is implemented through a suction wand that is able to be delivered in the majority of current steam generator tube gaps. The suction wand is delivered from the handhole, the no tube lane or from the circumferential annulus of the steam generator. It will comprise, preferably, at least one suction head capable of removing soft sludge deposits. Abilities also include lighting and video inspection for viewing cleaning results and tool position.

This method only requires the use of a single air operated diaphragm pump for a vacuum flow source. This replaces the current method of delivering high pressure water with flows from 25 to 48 GPM (gallons/minute) and up to 3,000 psi (204 atmospheres). The method (and its delivery system) can perform live cleanliness inspections, eliminating the need for the several platform set ups that are currently in use.

Figure 6:
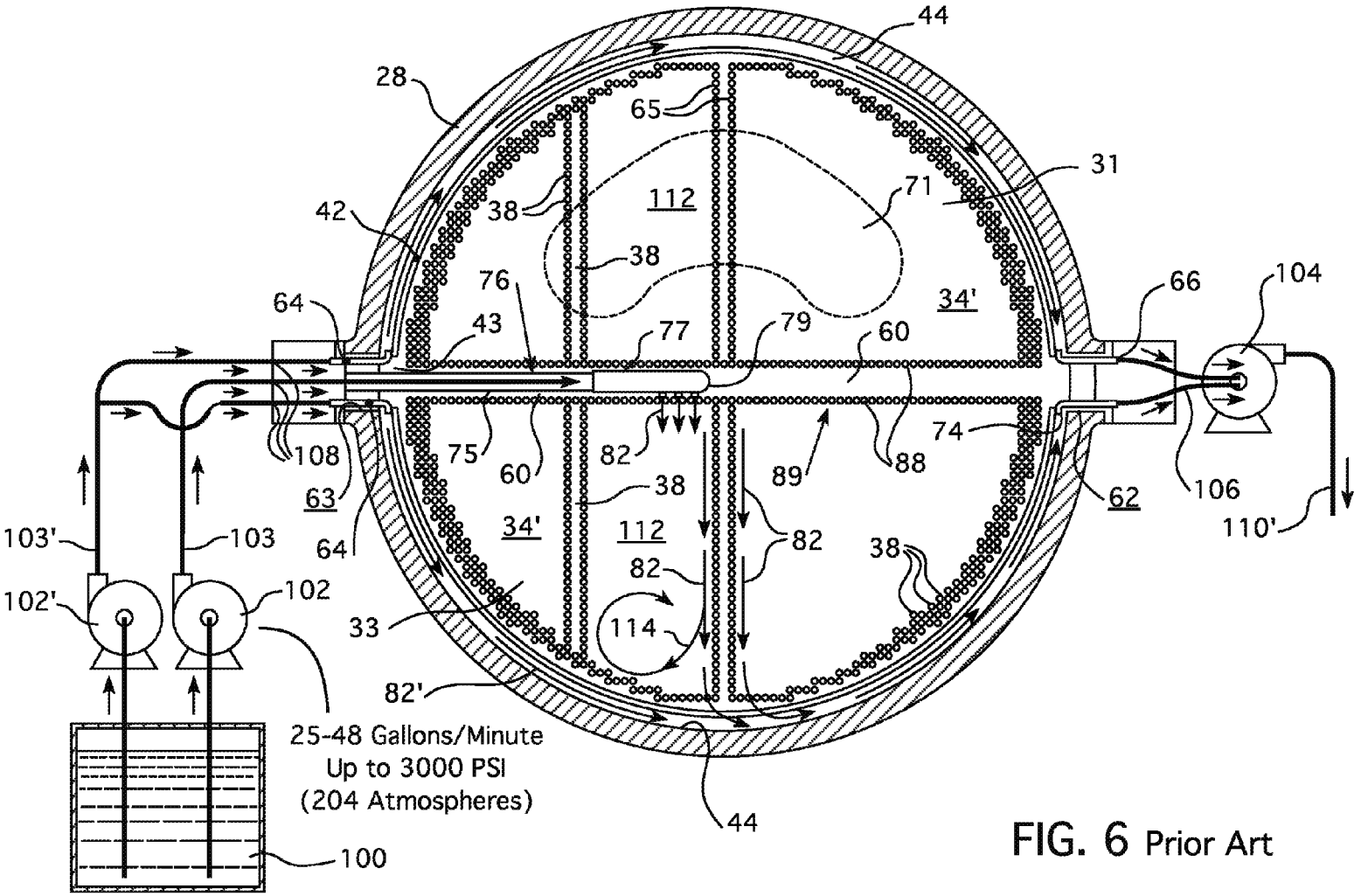
FIG. 6 Prior Art
FIG. 6 is a plan view of the tube sheet and tubes in a steam generator, with a standard prior art high pressure sludge lance system in place, usually requiring heavy equipment.

Referring now to an example of the prior art sludge removal process shown in FIG. 6, the sludge referred to forms on top of tube sheet 34' and around tubes 38. This sludge which usually comprises iron oxides, copper compounds, and other metals is formed from these materials settling out of the feedwater onto tube sheet top 34'. When the reactor is not operating, such as during refueling, the steam generator may be deactivated and drained of most of the feedwater. Handholes such as 62 and 63 can then be opened to provide access to the interior of the steam generator. Injection peripheral headers 64 can be placed through one of the handholes 63 while suction headers 66 can be placed through the other handhole 62. The injection header 64 and the suction header 66 are shaped to fit through the handholes 62 and 63 while being able to fit around any obstructions which might block the no tube lane 60. Injection header 64 is connected to fluid inlets 108 then to a fluid supply 100, such as a water supply, which may contain additives to help dissolve/remove the sludge. This fluid, in the fluid supply 100, is pumped 103, 103' by pumps 102, 102'. On the other side, suction header 66 is connected to a suction pump 104, such as an air diaphragm suction pump, through suction connector 106 to sludge exit line 110' for disposal.

Then, according to one aspect of the prior art, again shown in FIG. 2, a moveable high pressure, lance 76 with a head 77 is inserted into at least one of the handholes 62 and 63, through an opening 43 in the wrapper 42, where it proceeds down the no tube lane 60 between tubes 88 to clean gaps 89. As can be seen, the head 77 connected to a cleaning fluid supply 100, ejects cleaning fluid 82 (shown as arrows), such as pressurized water. There can be some reverse flow 114 into cleaned zone 112. A high sludge accumulating region is shown as 71 in the hot leg 31. Cold leg is shown as 33 separated from the hot leg by the no tube lane 60. Headers 64 can inject cleaning fluid 82' via annulus 44.

Figure 7:
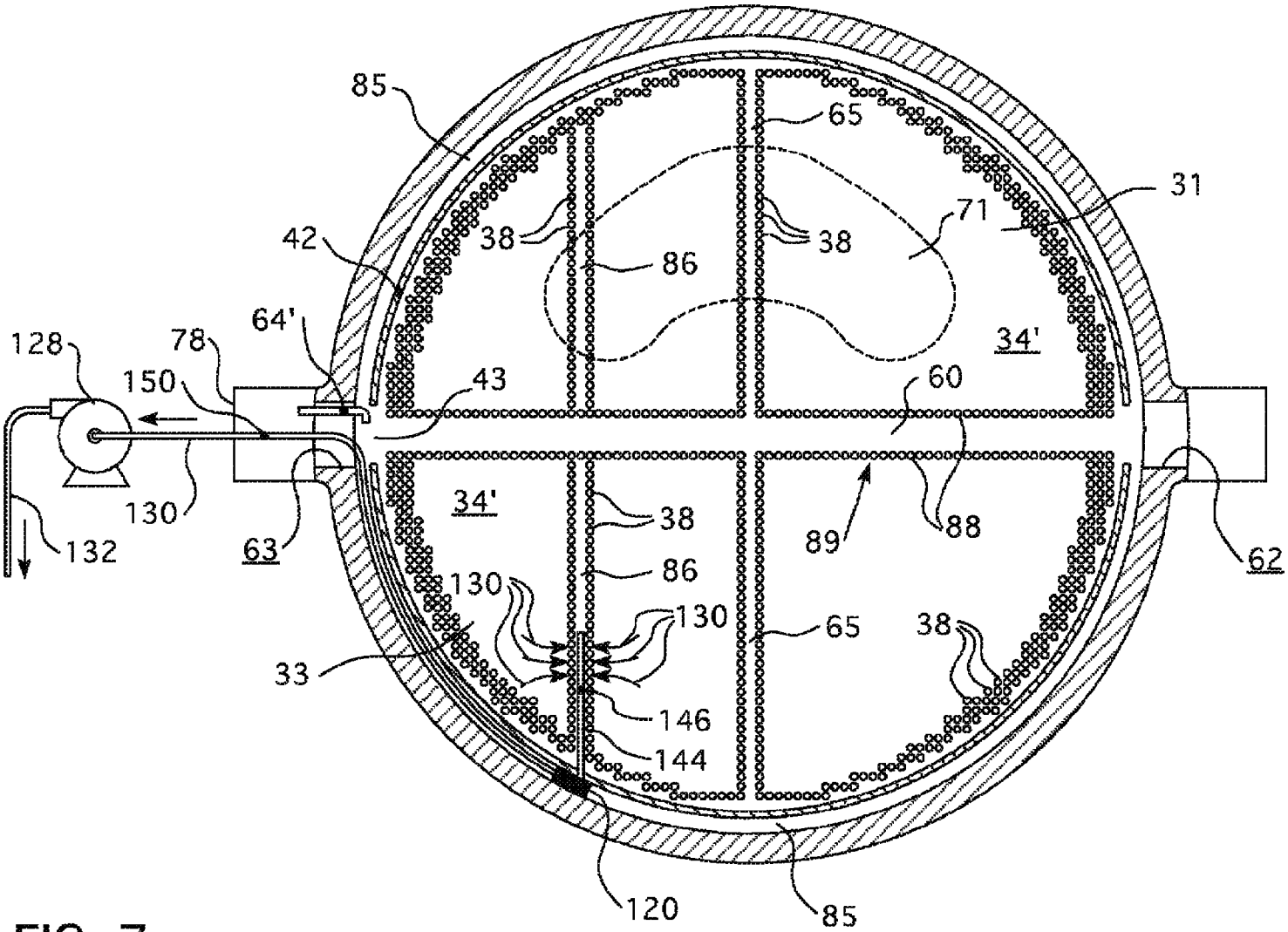
FIG. 7, which best shows the general invention, is a plan view of the tube sheet, with circumferential annulus and tubes in a steam generator, where a moveable sludge suction apparatus composed of a suction head and a wand assembly connected to a remote delivery system vacuums sludge directly in the tube bundle.

Referring now to FIG. 7, which best shows one embodiment of the invention, many of the same components are shown and labeled as in FIG. 6. Handholes are shown as 62, 63, the "no" tube lane is shown as 60. By opening the handholes, access to the center tube lane 60 and circumferential annulus 44 is allowed. At least one moveable sludge suction apparatus shown generally as 120 with a wand 144 including suction head 146 with at least one vacuum inlet 148 (shown in FIG. 8) is moved/introduced into the circumferential annulus 44, through handhole 63, as shown, to remove sludge 130 via pump 128 and sludge exit line 132.

The vacuum head(s) provide(s) a vacuum sufficient to remove aqueous sludge from the top surface of the tube sheet 34'. The vacuuming takes place after the steam generator has been drained, but with a sufficient volume of water still being present on top of the tube sheet to prevent the sludge from drying out. The vacuum is delivered through a nozzle on either side, both sides or the bottom of the suction head, providing a cleaning capability throughout the tube column as the suction head is advanced throughout the tube bundle. The apparatus must fit through the no tube lane 60 or annulus 44.

In operation, both the hot leg side 31 and the cold leg side 33 are vacuumed individually with the moveable sludge vacuum apparatus 120 with its wand 144 and suction head 146. Header 64' is optional. As water is removed with the sludge, clean water will have to be pumped back in order to maintain a constant water level. The moveable sludge suction apparatus 120 can be moved with a robotic delivery system like the one described above or other device connected to vacuum pump 128 by outlet sludge/control umbilical 150. Arrows 130 show sludge removal. An optional mounting mechanism 78 for apparatus 120 is shown. Vacuum pump 128 can extract sludge 130 and send the extracted sludge through exit line 132.

Figure 8:
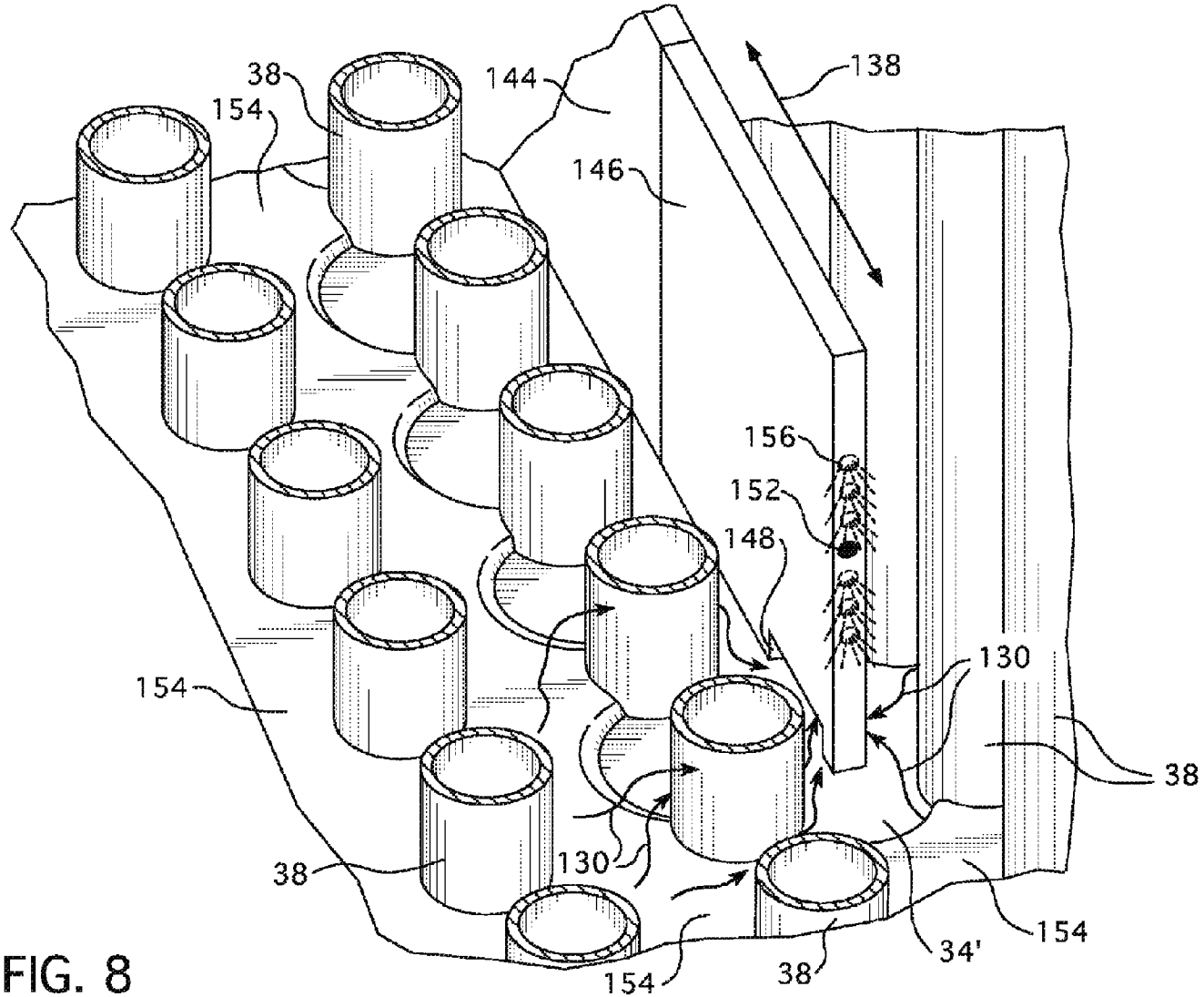
FIG. 8 is a conceptual design of one possible embodiment of the suction head and wand assembly that can be used in this invention, shown vacuuming between rows of tubes.

Referring now to FIG. 8, the wand 144 and suction head 146 of a moveable sludge suction apparatus is shown, including at least one vacuum inlet 148. The wand and suction head assembly can be extended or retracted shown by arrow 138, by any suitable mechanism known in the art attached to the moveable sludge vacuum apparatus shown in FIG. 7 as 120. The wand 144 can be collapsible, telescoping, pivoting, flexible, etc. Visual means such as an optical scanning device 152 can also be mounted/present on or in the suction head 146 to scan sludge removal results. Unremoved sludge is shown as 154 on top of the top surface of the tube sheet 34'.

Figure 9:
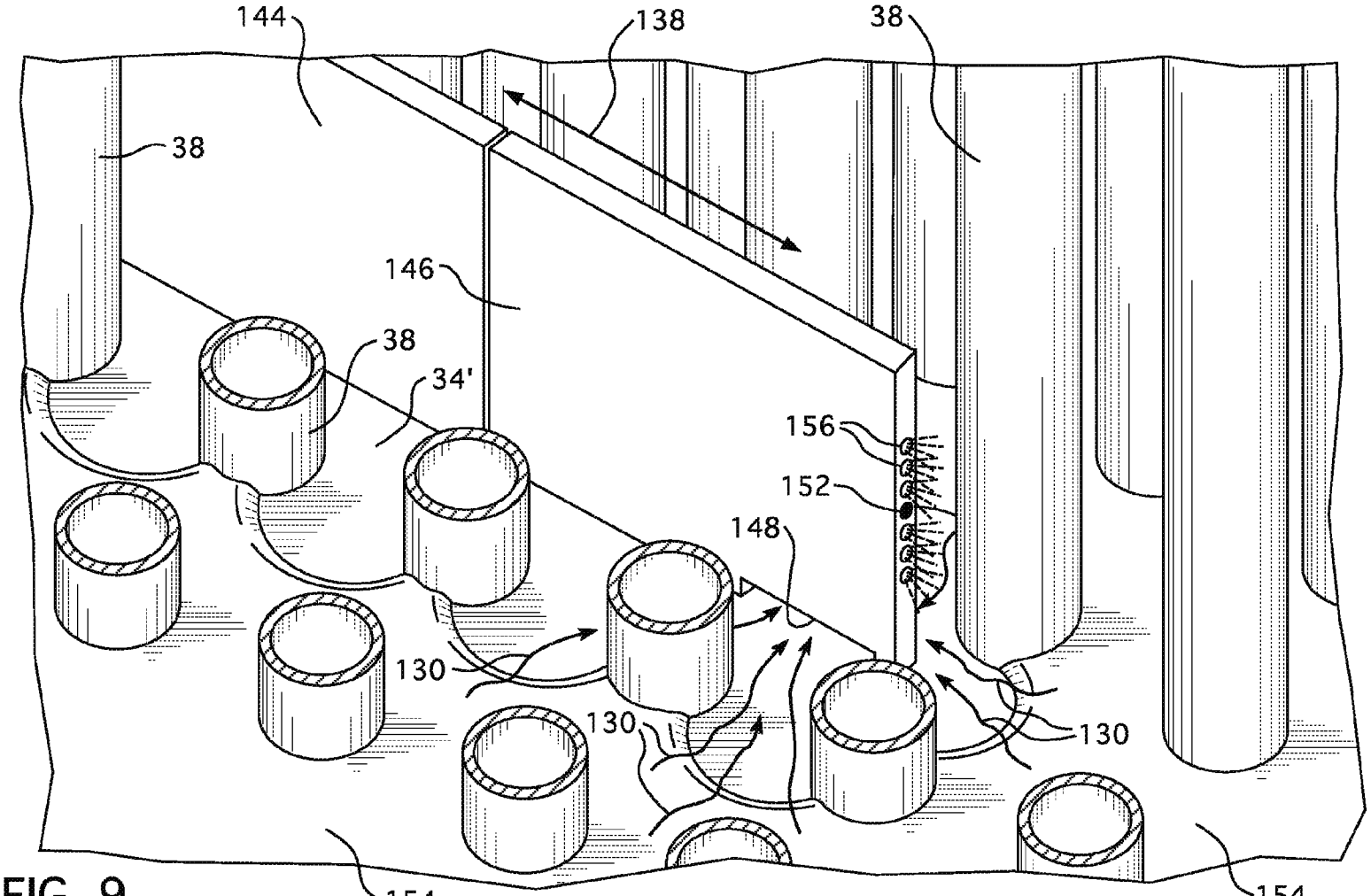
FIG. 9 is a side view of the suction head and wand of FIG. 4.

In FIG. 9, the top of the tube sheet 34' free of sludge is shown as well as tubes 38. Lighting 156 can be located on or in the suction head 146 to aid the visual means 152. As can be seen, in operation, aqueous sludge 154 is drawn, arrows 130, into the suction inlet. As shown, in one embodiment, the wand section and suction head advance on top of the top surface of the tube sheet.

While specific embodiments of the invention have been described in detail, it will be appreciated by those skilled in the art that various modifications and alternatives to those details could be developed in light of the overall teachings of the disclosure. While the preferred embodiments have been shown and described in a U-tube steam generator the invention can benefit other relatively large heat exchangers such as once through steam generators. Additionally, it should be appreciated that the delivery system descried herein can implement one or more additional capabilities, e.g., nondestructive examinations, foreign object retrievals, ultrasonic energy cleaning, electro polishing, etc. The delivery system can either provide these capabilities individually or can provide two or more of such capabilities in combination. Accordingly, the particular embodiments disclosed are meant to be illustrative only and not limiting as to the scope of the invention which is to be given the full breadth of the appended claims and any and all equivalents thereof.

What is claimed is:

1. A method of manipulating a tool within the secondary side of a steam generator having a tube sheet with a tube bundle having a plurality of heat exchange tubes extending from the tube sheet in rows with an annulus extending around the heat exchange tubes on a periphery of the tube bundle, between the tubes and a shell which surrounds the tube bundle, comprising the steps of:

inserting a robotic vehicle for transporting the tool, through the shell and into the annulus with the robotic vehicle sized to ride in the annulus, wherein the tool applies a vacuum to the tube sheet to vacuum loose aqueous sludge within the vicinity of a vacuum nozzle on the tool as the tool with the vacuum nozzle applying the vacuum is transported across the tube sheet;

positioning the robotic vehicle so that the tool is aligned in a tube lane between two rows of heat exchanger tubes;

extending the tool a substantial distance into the tube lane;

operating the tool while in an extended position within the tube lane; and adding a fluid comprising water to the tube sheet on the secondary side of the steam generator through a handhole in a lower part of the shell just above the tube sheet, while the tool is applying the vacuum within the tube lane to the tube sheet, to maintain a substantially constant water level cover over substantially the entire tube sheet as the vacuum draws off the loose sludge and the water, to prevent the sludge from drying out; wherein the robotic vehicle has a wand with a bend radius capable of traveling around an approximate ninety degree turn or bend, wherein the wand is at least in part, slidably supported in or on the robotic vehicle and extends out of the robotic vehicle a distance substantially parallel to the tube sheet, at least as long as a distance the tool is to be inserted into the tube lane, with one end portion of the wand extending along the annulus and connected to a second robotic vehicle and another end portion of the wand, bent the approximate ninety degrees, carrying the tool, wherein the step of extending the tool comprises moving the second robotic vehicle toward the first robotic vehicle.

2. The method of claim 1 wherein the tool is operated as it is extended through the tube lane.

3. The method of claim 1 wherein the tool is a sludge removal wand.

4. The method of claim 1 wherein the tool comprises a camera.

5. The method of claim 1 wherein the tool is suspended from the wand that has a capable bend radius and length to be contained in a reel delivery system wherein the extending step includes the step of rotating the reel to advance the lance into and through the tube lane.

6. The method of claim 1 including the steps of:

withdrawing the tool from the tool lane;

repositioning the robotic vehicle to be aligned with another tube lane; and inserting the tool through the another tube lane.

7. A method of sludge removal from a top of a tube sheet surface in a tubular steam generator having a plurality of heat exchange tubes extending from the tube sheet surface in rows to form a tube bundle with a circumferential annulus extending around the heat exchange tubes on a periphery of the tube bundle and a plurality of entry handholes allowing access to a no-tube lane extending over the tube sheet surface or to the circumferential annulus, comprising the steps of:

opening at least one handhole on an outer surface of a shell of the steam generator, allowing access to the no-tube lane and/or to the circumferential annulus;

introducing at least one moveable sludge suction apparatus within the no-tube lane and/or the circumferential annulus, said apparatus includes a suction head with at least one vacuum inlet;

moving the moveable sludge suction apparatus among the heat exchange tubes over the surface of the tube sheet;

sludge vacuuming of the top of tube sheet surface with the moveable sludge suction apparatus; and adding a fluid, comprising water, through at least one of the plurality of handholes in a lower part of the shell just above the tube sheet, to the top of the tube sheet surface while sludge vacuuming the tube sheet with the moveable sludge suction apparatus, within the tube lane, to maintain a substantially constant water level cover over substantially the entire tube sheet as the vacuum draws off the loose sludge and the water, to prevent the sludge from drying out; wherein the moveable sludge suction apparatus has a wand with a bend radius capable of traveling around an approximate ninety degree turn or bend, wherein the wand is at least in part, slidably supported in or on the sludge suction apparatus and extends out of the sludge suction apparatus a distance substantially parallel to the tube sheet, at least as long as a distance the tool is to be inserted into the tube lane, with one end portion of the wand extending along the annulus and connected to a robotic vehicle and another end portion of the wand, bent the approximate ninety degrees, carrying the suction head, wherein the step of extending the suction head comprises moving the robotic vehicle toward the sludge suction apparatus.

8. The method of claim 7, including inspecting the top of the tube sheet surface with at least one optical scanning device mounted on or in the suction head.

9. The method of claim 7, including lighting the path of the suction head with a lighting device mounted on or in the suction head.

10. The method of claim 7, where the wand connects the suction head to the moveable sludge suction apparatus.

11. The method of claim 7, wherein the moveable sludge suction apparatus is introduced into the no tube lane.

12. The method of claim 7, wherein the moveable sludge suction apparatus is introduced into the circumferential annulus.

13. The method of claim 7, wherein the wand connects the suction head to the moveable sludge suction apparatus, which wand moves the suction head between tubes of the tube bundle.

14. The method of claim 7, wherein the sludge is aqueous sludge having a water level, wherein the water level is maintained at a level above the tube sheet so the sludge does not dry out, by a separate injector header.

15. The method of claim 7, wherein a vacuum pump is used to remove sludge.

16. A remotely controlled robotic system for manipulating a tool over a tube sheet with a tube bundle within a secondary side of a tube and shell steam generator, the tube bundle having a plurality of heat exchange tubes extending from the tube sheet in rows with an annulus extending around the heat exchange tubes on a periphery of the tube bundle, between the tubes and a shell which surrounds the tube bundle, comprising:

a first robotic vehicle sized to ride in and at least partially around the annulus;

a wand is, at least in part, supported on and extendable from the first robotic vehicle substantially through a lane between two rows of heat exchange tubes and retractable through the first robotic vehicle, out of the tube lane, the tool being supported from a first end portion of the wand that extends from the first robotic vehicle through the lane between two rows of heat exchange tubes;

a controller for controlling the extension of the wand and operation of the tool during the extension; and wherein the wand has a bend radius capable of traveling around an approximate ninety degree turn or bend, wherein the wand is at least in part, slidably supported in or on the first robotic vehicle and extends out of the first robotic vehicle, through the annulus, a distance substantially parallel to the tube sheet, at least as long as a distance the tool is to be inserted into the lane between the two rows of heat exchange tubes, with a second end portion of the wand extending along the annulus being connected to a second robotic vehicle and the first end portion of the wand, bent the approximate ninety degrees, supporting the tool, the second robotic vehicle being sized to travel in the annulus independent of the first robotic vehicle to vary the length of the wand extending between the two rows of heat exchange tubes.

* * * * *